US007455219B2

(12) United States Patent
Langlotz et al.

(10) Patent No.: US 7,455,219 B2
(45) Date of Patent: Nov. 25, 2008

(54) METHOD FOR HANDLING CASSETTES FOR BANK NOTES

(75) Inventors: Matthias Langlotz, Hohenbrunn (DE); Hans Bomm, Taufkirchen (DE); Dirk Gottschling, München (DE); Andreas Donig, München (DE); Markus Hopfner, Rosenheim (DE); Gerhard Sporer, Aschering (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 10/583,767

(22) PCT Filed: Dec. 15, 2004

(86) PCT No.: PCT/EP2004/014298

§ 371 (c)(1),
(2), (4) Date: Jun. 7, 2007

(87) PCT Pub. No.: WO2005/064553

PCT Pub. Date: Jul. 14, 2005

(65) Prior Publication Data

US 2007/0229253 A1 Oct. 4, 2007

(30) Foreign Application Priority Data

Dec. 23, 2003 (DE) ..... 103 60 858

(51) Int. Cl.
*G07F 19/00* (2006.01)

(52) U.S. Cl. ..... 235/379; 235/380

(58) Field of Classification Search ..... 235/379, 235/380, 383, 375, 381; 221/211, 197, 6; 399/8, 9, 16, 361

See application file for complete search history.

(56) References Cited

U.S. PATENT DOCUMENTS

| | | | | |
|---|---|---|---|---|
| 4,511,794 | A | 4/1985 | Imamichi | |
| 4,816,652 | A * | 3/1989 | Wildgoose et al. | 235/379 |
| 5,357,329 | A * | 10/1994 | Ariyama et al. | 399/16 |
| 5,799,288 | A | 8/1998 | Tanaka et al. | |
| 6,065,672 | A | 5/2000 | Haycock | |
| 6,293,867 | B1 | 9/2001 | Heidel et al. | |
| 6,609,101 | B1 | 8/2003 | Landvater | |
| 6,786,354 | B2 * | 9/2004 | Black et al. | 221/6 |
| 7,120,365 | B2 * | 10/2006 | Yamazaki | 399/8 |
| 7,228,198 | B2 * | 6/2007 | Vollm et al. | 700/235 |
| 7,303,094 | B2 * | 12/2007 | Hutchinson et al. | 221/197 |
| 2008/0017661 | A1 * | 1/2008 | Hutchinson et al. | 221/211 |
| 2008/0038007 | A1 * | 2/2008 | Yamazaki | 399/75 |

FOREIGN PATENT DOCUMENTS

EP 0 753 524 1/1997

* cited by examiner

*Primary Examiner*—Thien M Le
(74) *Attorney, Agent, or Firm*—Bacon & Thomas, PLLC

(57) ABSTRACT

A method is provided for handling cassettes for bank notes, for automatic tellers and/or deposit devices. The method for handling cassettes for bank notes, for automatic tellers and/or deposit devices, includes the step of determining the filling level of the cassette or cassettes, comparing the determined filling level of each cassette with at least one threshold value lower than a maximum capacity of the particular cassette, and wherein, if the comparison yields an excess, the step of producing a signal indicating the exceeding of the threshold value, causing replacement of the cassette for which the signal indicating the exceeding of the threshold value was produced.

11 Claims, 2 Drawing Sheets

METHOD FOR HANDLING CASSETTES FOR BANK NOTES

FIELD OF THE INVENTION

Figure 1:
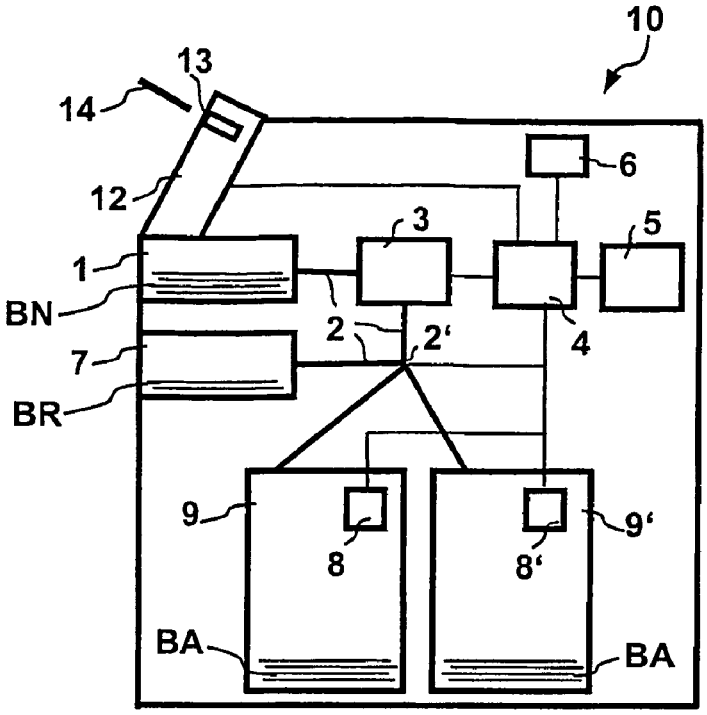

This invention relates to a method for handling cassettes for bank notes, for automatic tellers and/or deposit devices.

BACKGROUND

Upon the deposit of bank notes at automatic tellers and/or deposit devices, the deposited bank notes are checked for their properties, such as authenticity, state, type of bank note, i.e. currency and denomination, etc. Depending on the result of the check, the bank notes can be for example accepted, sorted, stored, etc. The accepted bank notes are stored using cassettes in which the bank notes are kept in order to be transported for example to a bank for accounting.

In the handling of the cassettes, however, a multiplicity of problems can arise resulting, on the one hand, from the fact that it should always be ensured as far as possible that the automatic tellers and/or the deposit devices are operable at all times. Such problems can arise for example when the maximum capacity of the cassettes is reached, because no further bank notes can then be deposited. On the other hand, it should be ensured in particular during transport that the bank notes contained in the cassettes cannot be tampered with or stolen, or that such tampering can be discovered.

Known solutions to these problems cannot completely compensate the arising disadvantages, since they either only partly solve the problems or are very elaborate to realize. For example, it has been proposed that a signal for replacing cassettes be produced after they have reached their maximum capacity. In this case, however, the automatic teller is still out of service until the time when the full cassette has been replaced by an empty one. For securing the transport of cassettes filled with bank notes, it has been proposed to provide substances in the cassette which are distributed over the bank notes located in the cassette to mark them in case tampering or theft occurs.

It is the problem of the present invention to specify a method for handling cassettes for bank notes, for automatic tellers and/or deposit devices, which allows uninterrupted operation of the automatic tellers and/or deposit devices. In a further aspect, it should be ensured that cassettes removed from the automatic tellers and/or deposit devices, or the bank notes contained therein, are secured against tampering.

The inventive method for handling cassettes for bank notes, for automatic tellers and/or deposit devices, provides for determining the filling level of the cassette or cassettes, comparing the determined filling level of each cassette with at least one threshold value lower than a maximum capacity of the particular cassette, if the comparison yields an excess, producing a signal indicating the exceeding of the threshold value, and causing replacement of the cassette for which the signal indicating the exceeding of the threshold value was produced.

The inventive method has in particular the advantage that the timely replacement of the cassettes, i.e. as a rule before the maximum capacity is reached, makes it possible to ensure the uninterrupted operation of the automatic tellers and/or deposit devices. For this purpose, a signal requesting replacement of the cassettes is produced in such good time that the replacement can be carried out as a rule before the maximum capacity is reached. It has proved especially advantageous to specify flexibly the moment when the signal for replacement is produced and to determine it in dependence on the time required for replacement and/or the number of bank notes usually accepted by the automatic teller and/or the deposit device per unit time.

In the further aspect, it is provided for storing information about bank notes contained in the cassette as cassette data, in a special, non-evaluable data format, in a nonvolatile memory associated with the cassette.

Securing the information about the bank notes contained in the cassettes makes it possible to ensure that any tampering with the bank notes or theft of bank notes contained in the cassettes can be recognized at any time. This cannot be prevented by changing the information about the bank notes stored in the nonvolatile memory of the cassettes in accordance with the tampering or theft.

DETAILED DESCRIPTION OF THE DRAWINGS

Figure 2:
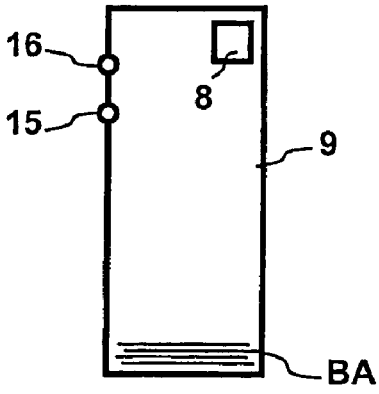
Figure 3:
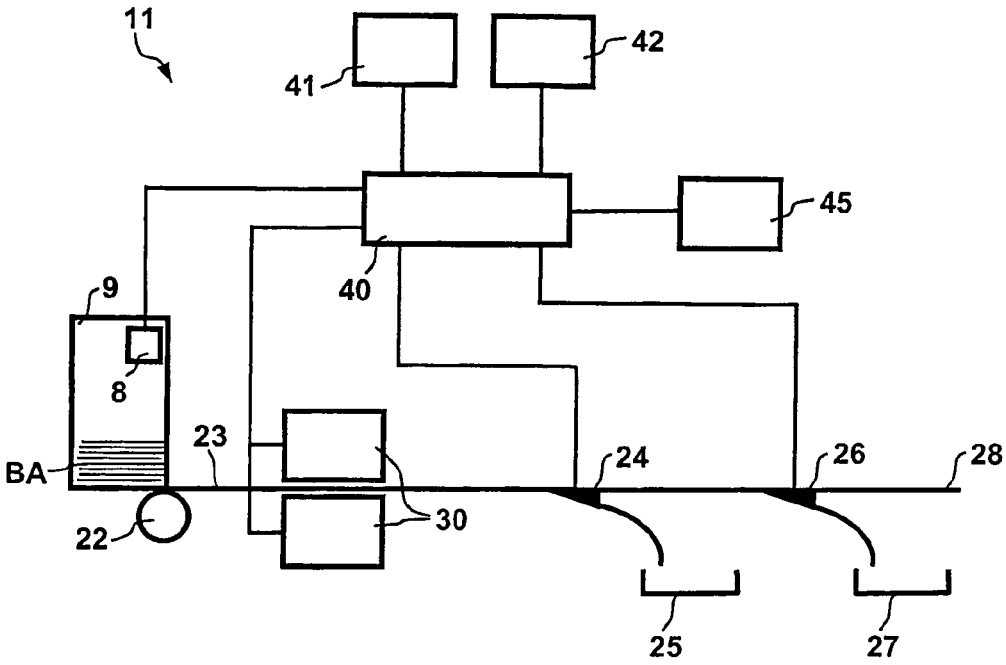
Figure 4:
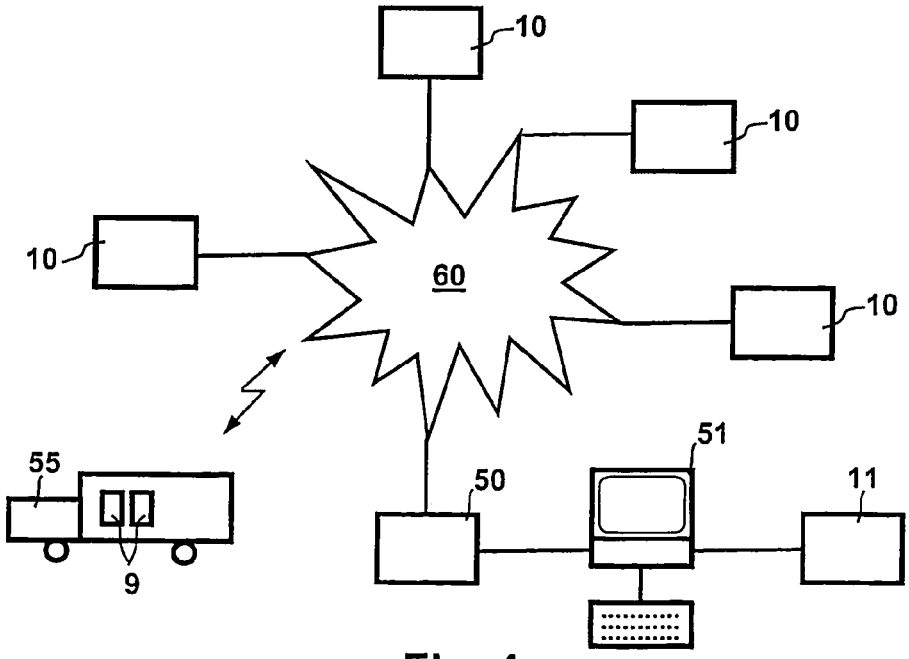

The figures are described as follows:

FIG. 1 an automatic teller for depositing bank notes, with cassettes for receiving the deposited bank notes, FIG. 2 an example of a schematic structure of the cassettes from FIG. 1, FIG. 3 a bank note processing machine for checking the content of the cassettes from FIG. 1, and FIG. 4 a system for handling the cassettes from FIG. 1.

DETAILED DESCRIPTION OF VARIOUS EMBODIMENTS

FIG. 1 shows a schematic representation of a schematic structure of an automatic teller 10 or deposit device for depositing bank notes.

The automatic teller 10 has an input pocket 1 into which bank notes BN to be deposited are fed by a depositor. The bank notes BN are removed from the input pocket 1 by a transport system 2 and supplied to a sensor device 3. The sensor device 3 detects features of each individual bank note which are relevant for example for judging authenticity, type (currency, denomination), state, etc., of the bank note. Such features can be detected for example by different sensors mechanically, acoustically, optically, electrically and/or magnetically. Known authenticity features comprise for example printing inks with special optical and/or magnetic properties, metallic or magnetic security threads, the use of brightener-free bank-note paper, information contained in an electrical circuit, etc. The type of the bank note is defined e.g. by its size, printed pattern, colors, etc., whereas the state of the bank note can be derived for example from the optical appearance (soiling). The features are detected by the sensor device 3, and corresponding data of the sensor device 3 transferred to a control device 4.

The control device 4 compares the data of the detected features with comparative data which permit the recognition of authentic or forged and/or suspicious bank notes, the type of the bank notes, the state of the bank notes, etc. The comparative data as well as programs required for operating the automatic teller 10 are present in the form of software and stored in the control device 4 or a nonvolatile memory 5 associated with the control device 4. The nonvolatile memory 5 can be formed e.g. by an EEPROM or a flash memory, a hard disk, etc. Further, a working memory not shown can be connected to the control device 4, being used by the control device 4 for executing the software.

On the basis of the check of the particular bank note performed by the control device 4, gates 2' disposed in the transport system 2 are driven, for example to transport nonrecognized bank notes BR into a return pocket 7 and to transport accepted bank notes BA, e.g. depending on their denomination, into a cassette 9, 9' to be kept therein. At the same time, information relating to the kept bank notes BA is stored in a nonvolatile memory 8, 8' of the cassettes 9, 9', which can be formed e.g. by an EEPROM or flash memory. The nonvolatile memory 8, 8' can be connected wirelessly or by wire to the control device 4 from which the information about the bank notes BA for the cassette 9, 9' comes. The cassette data formed by the information in the non-volatile memory 8, 8' can comprise for example the number of bank notes BA, the particular denomination and/or currency of the bank notes BA and the total value of the bank notes BA. Moreover, the cassette data can comprise information about the depositor, e.g. an account number of the depositor. Further information in the nonvolatile memory 8, 8' can be an identification number of the cassette 9, 9' and/or an identification number of the automatic teller 10 in which the cassette 9, 9' is used.

For control of the automatic teller 10 by the depositor, an input/output device 12 is connected to the control device 4, for example to permit the selection of certain processing modes or inform the depositor about the processing of the deposit. The input/output device 12 furthermore has an identification device 13, for example a reader for a chip card or magnetic strip card 14. By entering his individual card 14 the depositor can identify himself at the automatic teller and cause the total amount corresponding to the deposited bank notes to be credited to his account.

FIG. 2 shows a schematic structure of an embodiment of the cassette 9 or 9'. The cassette 9 has not only the above-described nonvolatile memory 8 but also sensors 15, 16 which serve to detect how many bank notes BA have already been received in the cassette 9. The first sensor 15 produces a signal when the maximum capacity of the cassette 9 is reached to a certain degree, e.g. 80%. The second sensor 16 produces a signal when the maximum capacity of the cassette 9 is reached. The signals of the sensors 15, 16 are evaluated by the control device 4. If a signal is present from the second sensor 16, no further bank notes can be received in the cassette 9 since the maximum capacity has already been reached. However, if a signal of the first sensor 15 is present, bank notes can still be received in the cassette 9. If a signal of the first sensor 15 is present the control device 4 produces an additional signal, however, which it passes on to a bank or a service center via an interface 6 which is likewise provided in the automatic teller 10 and can be designed e.g. as a modem, network connection, Internet connection, telephone connection, etc. The service center then has a service person replace the filled cassette 9 by an empty cassette. Since the control device 4 already produces the signal to the service center before the maximum capacity of the cassette 9 is reached, there is sufficient time to replace the full cassettes 9 by empty cassettes, so that uninterrupted operation of the automatic teller 10 is guaranteed.

Besides the described cassette 9 having sensors 15, 16 for detecting the filling level of the cassette 9, a cassette 9 is also possible that has no or different sensors, whereby in particular only the sensor 15 indicating a certain filling level of the cassette 9 can be present. Likewise, sensors can be completely omitted in the cassette 9 if the number of bank notes BA already kept in the cassette 9 is determined and stored. If the cassette 9 can receive e.g. 3000 bank notes, the control device 4 can send the signal to the service center via the interface after for example 2500 bank notes have been received in the cassette. In the eventuality that the cassette 9 contains a deposit platform on which the bank notes BA are placed and which is moved depending on the filling level, the position of the deposit platform within the cassette can be evaluated by the control device 4 to produce the signal for replacing the cassettes.

Besides the described firm specification of a certain threshold value for producing the signal for replacing the cassette 9, a variable threshold value can also be provided. Said variable threshold value can be specified by taking into account the average time necessary for replacing the filled cassette 9 by a service person. If this period of time is multiplied by the average quantity of bank notes deposited within a certain time period, the threshold value can be optimally determined. If it takes the service person e.g. an average of three hours to replace a cassette 9 of a certain automatic teller, and an average of 100 bank notes are deposited during one hour, it is to be expected that another 300 bank notes must be received in the cassette 9 until replacement of the cassette 9. At a maximum capacity of 3000 bank notes, the threshold value for production of the signal by the control device is thus 2700 bank notes. A further flexibilization of the threshold value can be obtained by taking account of the time dependence of the underlying processes. For example, the replacement of the cassette 9 will last longer at the time of rush-hour traffic, because the service person can be expected to need more time to reach the automatic teller 10 in the heavy traffic. Likewise, a time of day and/or a certain weekday can be taken into account, since e.g. after business hours more bank notes are accepted within a certain time because that is when the daily receipts of stores are deposited.

Likewise, further or additional threshold values can be specified. One threshold value can be formed by the reaching of a maximum total value of all bank notes in one or all cassettes 9, 9', which can be given e.g. by an insurance value. A further threshold value can be given by the maximum capacity of the nonvolatile memory 8, 8' of the cassettes 9, 9', thereby ensuring that the information about all bank notes contained in the cassette 9, 9' can be stored in the cassette data of the nonvolatile memory 8, 8'.

FIGS. 3 and 4 show schematic representations of a schematic structure of a system for handling cassettes for bank notes.

The system can comprise one or more automatic tellers 10 or deposit devices which are connected by means of their interfaces 6 via a network 60, e.g. a telephone network, a local network, the Internet, etc., to a bank or service center which comprises e.g. a computer 51 with an interface 50. Via the interfaces 6 of the automatic tellers 10 the above-described signals, which are produced when the threshold value or values are reached or exceeded, are passed to the service center. By the computer 51 of the service center, or a person operating the computer 51, a service person driving to the individual locations of the automatic tellers 10 e.g. in a vehicle 55 is asked for example via a mobile phone connection to drive to the automatic teller 10 that has produced the corresponding signal and sent it to the service center, in order to replace the corresponding filled cassette 9 by an empty cassette. The filled cassettes 9 are conveyed to the service center by the service person with the vehicle 55. At the service center the filled cassettes 9 are emptied and the content of the cassettes 9 is checked.

For the check, the bank note processing machine 11 shown in FIG. 3 can e.g. be used. The bank note processing machine 11 has an input pocket for inputting the bank notes BA to be checked from the cassette. In the representation the input pocket is formed by a coupling which permits the cassette 9 to be coupled to the bank note processing machine 11 in such a way that a singler 22 engages the cassette. The singler 22 grasps one of the bank notes BA to be processed at a time and transfers the single bank note to a transport system 23 which transports the single bank note through a sensor device 30. The sensor device 30 detects the features of the bank notes BA and passes on corresponding data to a control device 40. The control device 40 compares the data of the detected features with comparative data which permit the recognition of authentic or forged and/or suspicious bank notes, the type of the bank notes, the state of the bank notes, etc. The comparative data as well as programs required for operating the bank note processing machine 11 are present in the form of software and stored in the control device 40 or a nonvolatile memory 41 associated with the control device 40. The nonvolatile memory 41 can be formed e.g. by an EEPROM, a flash memory, a hard disk, etc. Further, a working memory not shown can be connected to the control device 40, being used by the control device 40 for executing the software. On the basis of the check of the particular bank note performed by the control device 40, gates 24, 26 disposed in the transport system 23 are driven in order to deposit the bank note in output pockets 25 or 27 for example. The transport system 23 can furthermore be continued 28 so that e.g. further output pockets can be provided.

For control of the bank note processing machine 10 by an operator, an input/output device 45 is connected to the control device 40, for example to permit the selection of certain processing modes or to inform the operator about the processing of the bank notes 21.

The accounting data, such as number, denomination and/or currency, total value, etc., produced by the control device 40 during processing of the bank notes BA are compared with the data stored in the nonvolatile memory 8 of the cassette 9. For this purpose, the control device 40 is connected, wirelessly or by wire, to the nonvolatile memory 8 of the cassette 9. A match of the data guarantees that the cassette 9, or the bank notes BA contained therein, were not tampered with during transport. The results produced by the control device 40 during processing of the bank notes BA and/or the data of the nonvolatile memory 8 can also be transmitted to the computer 51 of the service center. For transmitting the data there is an interface 42 which can be designed e.g. as a modem, network connection, Internet connection, as a parallel, serial or USB interface, etc.

For securing the cassette data stored in the nonvolatile memory 8 it can be provided that the cassette data are stored in the nonvolatile memory 8 in encrypted and/or compressed and/or scrambled, etc., form, i.e. in a special data format which ensures that the cassette data cannot be read from the memory 8, or the information contained in the cassette data cannot be recognized. This ensures that the cassette data of the nonvolatile memory 8 cannot be tampered with for covering up unauthorized actions, for example to adapt the cassette data when bank notes have been removed from the cassette 9 without authorization. The use of the special data format moreover permits a memory with low storage capacity to suffice for the nonvolatile memory 8.

After transport of the cassette 9 to the service center, the cassette data stored in the nonvolatile memory 8 are read, e.g. on the above-described bank note processing machine 11 or on an accordingly designed interface of the computer 51. Additionally, it can be provided that the bank note processing machine 11 or the computer 51 contains master data for the cassette 9, which are transmitted e.g. via the network 60 from the automatic teller 10. The master data can be transferred for example at the time when the cassette 9 is removed by the service person. However, they can also be transmitted at any other time, e.g. at the onset of the check of the content of the cassette 9 at the service center. Likewise, the master data can be stored in the nonvolatile memory 8 of the cassette 9, or in the computer 51, when a cassette 9 is being used for the first time or before the cassette 9 is reused in an automatic teller 9. The nonvolatile memory 8 of the cassettes 9 can then be read by means of the master data, whereby the master data can contain information about the use of the cassette 9. The master data can contain in particular a name and/or an identification number of the user as well as subgroups formed by the user, e.g. certain cash registers, etc. If the master data are stored in the nonvolatile memory 8 of the cassettes 9, they contain e.g. a cassette number, a number of the automatic teller 10, date and time of insertion and/or removal of the cassette 9 into/from the automatic teller 10, an indication of the currency used, etc.

The master data are used to convert the cassette data present in the above-described, special data format into a data format that allows evaluation of the information contained therein. For this purpose, a file in so-called XML format (eXtended Markup Language) can be formed from the cassette data for example. This can be done e.g. by means of a special parser which produces XML tags and enters the associated data. The information contained in the thus produced file is compared with the accounting data produced by the bank note processing machine 11 during processing of the bank notes BA of the cassette 9. In case of a match it can be assumed that the cassette 9, or the bank notes BA, were not tampered with during transport.

Besides the described embodiment, a multiplicity of variations is possible.

For example, the computer 51 at the service center can be omitted, if the control device 40 of the bank note processing machine 11 is used accordingly.

Likewise, it is possible to use not only the cassette 9, 9' shown as a stacking cassette, in which the bank notes BA are stacked with the same alignment, but also a free-fall cassette, in which the bank notes are input one after the other without proper stacking being taken into account.

The threshold value or values for production of the signal for replacing the cassette 9, 9' by the control device 4 of the automatic teller 10 can also be adjusted to a certain value or changed by a service person at the automatic teller 10. For this purpose, the service person can identify himself e.g. with a special card 14 and select a suitable operating mode for changing the threshold value or values. The change of the threshold value or values can also be carried out by the computer 51 at the service center or a service person via the network 60.

It is likewise obvious that, independently of the use of the threshold value or values for production of the signal for replacing the cassette 9, 9', the above-described use of the cassette data with the special data format can be used alone for securing the cassette 9, 9', or the bank notes BA contained therein.

It is also conceivable that the information contained in the cassette data is additionally transmitted upon the above-described transmission of the master data from the automatic tellers 10 to the service center via the network 60. In this case, the information about the bank notes BA gained from the cassette data can be compared again with the information transmitted from the particular automatic teller 10, thereby further increasing security.

Further, it is possible that a request to replace cassettes 9, 9' is also transmitted from one of the automatic tellers 10 via the network 60 to the service person directly, bypassing the service center.

It should also be pointed out that although solely automatic tellers 10 for accepting bank notes have hitherto been spoken of, it is of course also possible to use automatic tellers 10 that can furthermore output bank notes.

The invention claimed is:

1. A method for handling cassettes for bank notes, comprising the steps:

determining the filling level of at least one cassette, comparing the determined filling level of the at least one cassette with at least one threshold value lower than a maximum capacity of the at least one cassette, producing a signal indicating the exceeding of the threshold value if the comparison yields an excess, and causing a replacement of the at least one cassette for which the signal indicating the exceeding of the threshold value was produced;

wherein information about the bank notes contained in the at least one cassette is stored as cassette data, in a special, non-evaluable data format, in a nonvolatile memory associated with the at least one cassette;

wherein master data for the at least one cassette are produced in an automatic teller and transmitted to a service center independently of the at least one cassette, and the master data are suitable for evaluating the information contained in the cassette data.

2. The method according to claim 1, wherein the threshold value is variable.

3. The method according to claim 2, wherein the threshold value is specified in dependence on one or both time of day and weekday.

4. The method according to claim 2, wherein the threshold value is specified in dependence on the time duration required for replacing the at least one cassette.

5. The method according to claim 1, wherein the threshold value corresponds to a number of bank notes contained in the at least one cassette which is lower than the maximum capacity of the at least one cassette specified by a maximum permissible number of bank notes.

6. The method according to claim 1, wherein the threshold value corresponds to a total value of bank notes contained in the at least one cassette which is lower than the maximum capacity of the at least one cassette specified by a maximum permissible total value.

7. The method according to claim 6, including multiple cassettes, and wherein the threshold value corresponds to a total value of the bank notes present in all cassettes.

8. The method according to claim 1, wherein the multiple cassettes are associated with an automatic teller and wherein the cassette data contain information about number, denomination, currency, total value, time of deposit at the automatic teller and identity of a depositor.

9. The method according to claim 1, wherein the information contained in the cassette data is used for checking the bank notes contained in the at least one cassette.

10. A system comprising one or both an automatic teller and a deposit device, the system arranged to:

determine the filling level of at least one cassette, compare the determined filling level of the at least one cassette with at least one threshold value lower than a maximum capacity of the at least one cassette, produce a signal indicating the exceeding of the threshold value if the comparison yields an excess, and cause a replacement of the at least one cassette for which the signal indicating the exceeding of the threshold value was produced;

wherein information about the bank notes contained in the at least one cassette is stored as cassette data, in a special, non-evaluable data format, in a nonvolatile memory associated with the at least one cassette;

wherein master data for the at least one cassette are produced in the automatic teller and transmitted to a service center independently of the at least one cassette, and the master data are suitable for evaluating the information contained in the cassette data.

11. A cassette for bank notes operable with one or both an automatic teller and a deposit device, the cassette arranged to:

determine the filling level of the cassette, compare the determined filling level of the cassette with at least one threshold value lower than a maximum capacity of the cassette, produce a signal indicating the exceeding of the threshold value if the comparison yields an excess, and cause a replacement of the cassette for which the signal indicating the exceeding of the threshold value was produced;

wherein information about the bank notes contained in the cassette is stored as cassette data, in a special, non-evaluable data format, in a nonvolatile memory associated with the cassette;

wherein master data for the at least one cassette are produced in the automatic teller and transmitted to a service center independently of the cassette, and the master data are suitable for evaluating the information contained in the cassette data.

* * * * *